US010625995B2

(12) United States Patent
Vaughn et al.

(10) Patent No.: US 10,625,995 B2
(45) Date of Patent: Apr. 21, 2020

(54) WINCH INCLUDING ROTATABLE TIE STRUCTURE

(71) Applicant: Warn Industries, Inc., Clackamas, OR (US)

(72) Inventors: Eric Vaughn, Milwaukie, OR (US); Darren G. Fretz, Oregon City, OR (US)

(73) Assignee: WARN INDUSTRIES, INC., Clackamas, OR (US)

( * ) Notice: Subject to any disclaimer, the term of this patent is extended or adjusted under 35 U.S.C. 154(b) by 272 days.

(21) Appl. No.: 15/726,129

(22) Filed: Oct. 5, 2017

(65) Prior Publication Data

US 2018/0118529 A1 May 3, 2018

Related U.S. Application Data

(60) Provisional application No. 62/414,540, filed on Oct. 28, 2016.

(51) Int. Cl.

| | |
|---|---|
| ***B66D 1/16*** | (2006.01) |
| ***B66D 1/00*** | (2006.01) |
| ***B66D 1/28*** | (2006.01) |
| ***B66D 1/12*** | (2006.01) |
| ***B66D 1/22*** | (2006.01) |
| *B66D 1/36* | (2006.01) |
| *B66D 1/40* | (2006.01) |

(52) U.S. Cl.

CPC ..... *B66D 1/16* (2013.01); *B66D 1/00* (2013.01); *B66D 1/12* (2013.01); *B66D 1/22* (2013.01); *B66D 1/28* (2013.01); *B66D 1/36* (2013.01); *B66D 1/40* (2013.01)

(58) Field of Classification Search

CPC ... B66D 1/28; B66D 1/40; B66D 1/36; B66D 1/00; B66D 1/12; B66D 1/16; B66D 1/22

See application file for complete search history.

(56) References Cited

U.S. PATENT DOCUMENTS

| | | | | |
|---|---|---|---|---|
| D703,414 | S | 4/2014 | Fretz et al. | |
| D740,513 | S | 10/2015 | Fretz et al. | |
| 9,266,702 | B2 * | 2/2016 | Fretz | B66D 1/02 |
| 2014/0001427 | A1 * | 1/2014 | Fretz | B66D 1/02 254/342 |
| 2014/0252286 | A1 * | 9/2014 | Averill | B66D 1/16 254/344 |
| 2014/0257631 | A1 * | 9/2014 | Heravi | B66D 1/42 701/36 |
| 2016/0167935 | A1 | 6/2016 | Fretz et al. | |
| 2016/0194184 | A1 | 7/2016 | Fretz et al. | |

* cited by examiner

*Primary Examiner* — Emmanuel M Marcelo
(74) *Attorney, Agent, or Firm* — K&L Gates LLP

(57) ABSTRACT

Methods and systems are provided for a winch including a rotatable tie structure. In one example, a winch may include a tie structure coupled to a top side of a winch. Notches formed in main cross rails of the tie structure enable rotation of the tie structure relative to a housing of the winch.

20 Claims, 9 Drawing Sheets

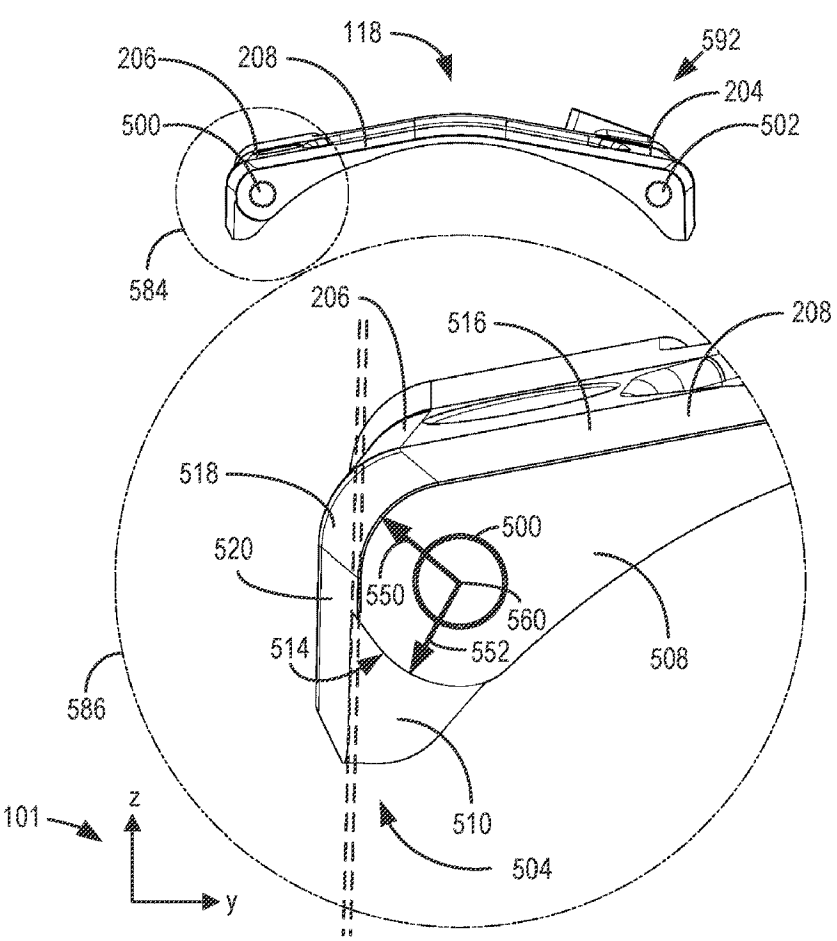
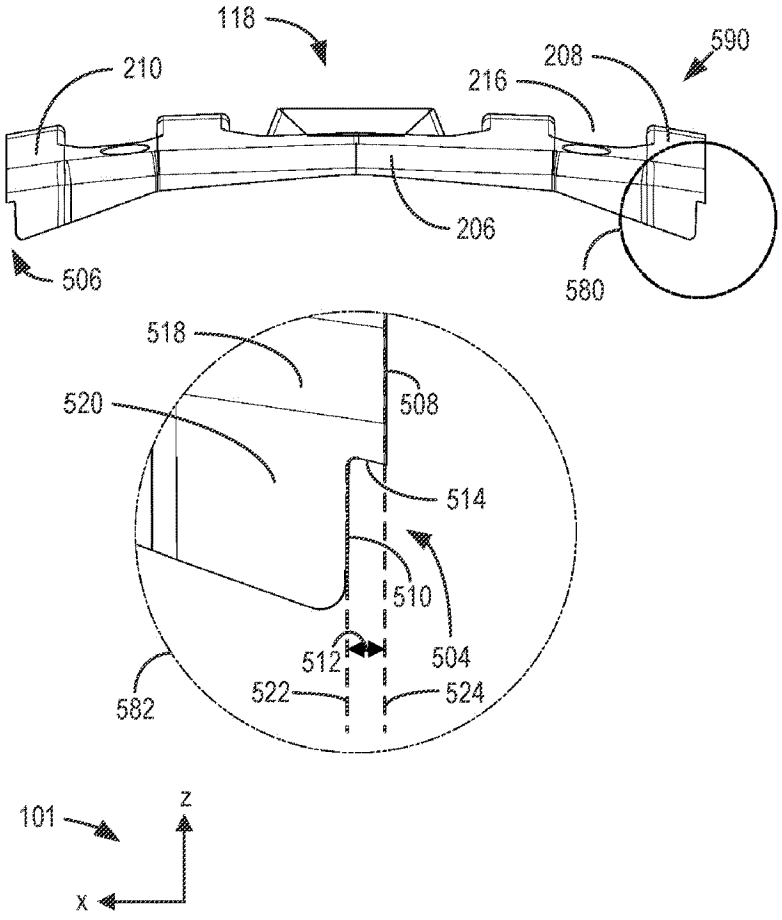
FIG. 5

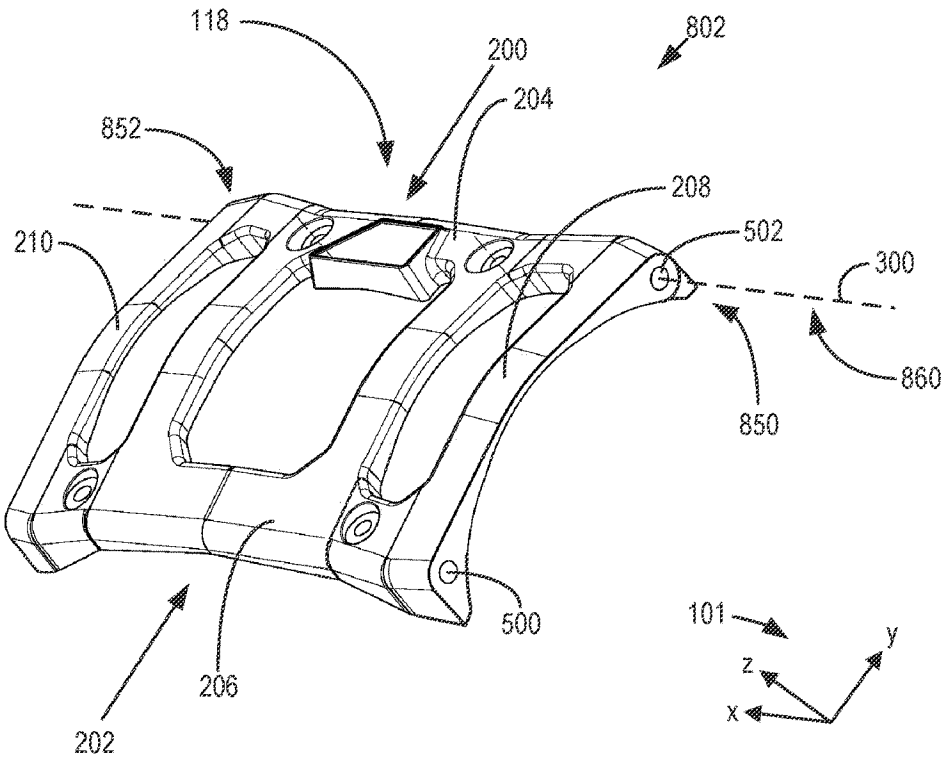
802
118
200
204
208
502
300
860
850
852
210
500
206
202
101
y
z
x
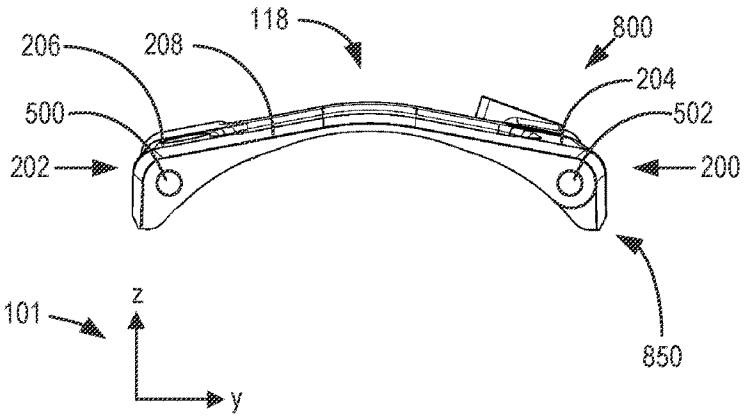
800
118
204
502
200
850
208
206
500
202
101
z
y

WINCH INCLUDING ROTATABLE TIE STRUCTURE

CROSS REFERENCE TO RELATED APPLICATIONS

The present application claims priority to U.S. Provisional Patent Application No. 62/414,540, entitled "WINCH INCLUDING ROTATABLE TIE STRUCTURE," filed on Oct. 28, 2016, the entire contents of which is hereby incorporated by reference in its entirety for all purposes.

FIELD

The present application relates generally to a winch including a rotatable tie structure.

SUMMARY AND BACKGROUND

Winches may include a motor attached to a first drum support and a transmission attached to a second drum support, with a rotatable drum disposed between the first and second drum supports. A tie structure may be fastened to the first and second drum supports and may be positioned vertically above the drum. Some winches may also include a control unit coupled to a top surface of the tie structure.

In some situations, an operator of the winch may want to remove the control unit from the winch in order to service the control unit and/or alternate components of the winch. Additionally, removal of the control unit may be necessary to attach or remove the winch cable (e.g., rope) to or from the drum. Ordinarily, in order access the control unit mounting fasteners for control unit uncoupling from the tie structure, the winch cable may have to be unwound some or all of the way from the drum. This process of coupling and/or uncoupling the control unit from the winch may increase an amount of time and effort in servicing the winch components and/or attaching/detaching the winch rope to/from the winch drum.

Thus in one example, the above issues may be at least partially addressed by a winch, comprising: a housing including a first drum support and a second drum support; a drum rotatable about a central axis, a first end of the drum supported by the first drum support and a second end of the drum supported by the second drum support; and a tie structure positioned directly above and extending across the drum, between the first and second drum supports and from a first to second end of each of the first and second drum supports, where the tie structure is rotatable about a rotational axis arranged at a first side of the tie structure that extends across the drum from the first drum support to the second drum support. In this way, the tie structure may remain secured to the winch and may be rotated in order to increase access to mounting fasteners of the control unit and to the drum. In this way, the control unit may be more easily and quickly coupled and uncoupled to and from the tie structure and the winch drum may be accessed without removing the control unit and/or tie structure from the winch. As a result, servicing of the winch components and/or coupling of a winch cable to the drum may be more easily and quickly accomplished.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 5 shows a back view and a side view of the tie structure, and additionally includes a first and second enlarged view of a notch formed at a first side of the tie structure.

FIG. 8 shows two views of a second embodiment of a rotatable tie structure including notches formed at a second side of the tie structure.

FIGS. 1-9 are shown to scale, although other relative dimensions may be used.

DETAILED DESCRIPTION

Figure 9:
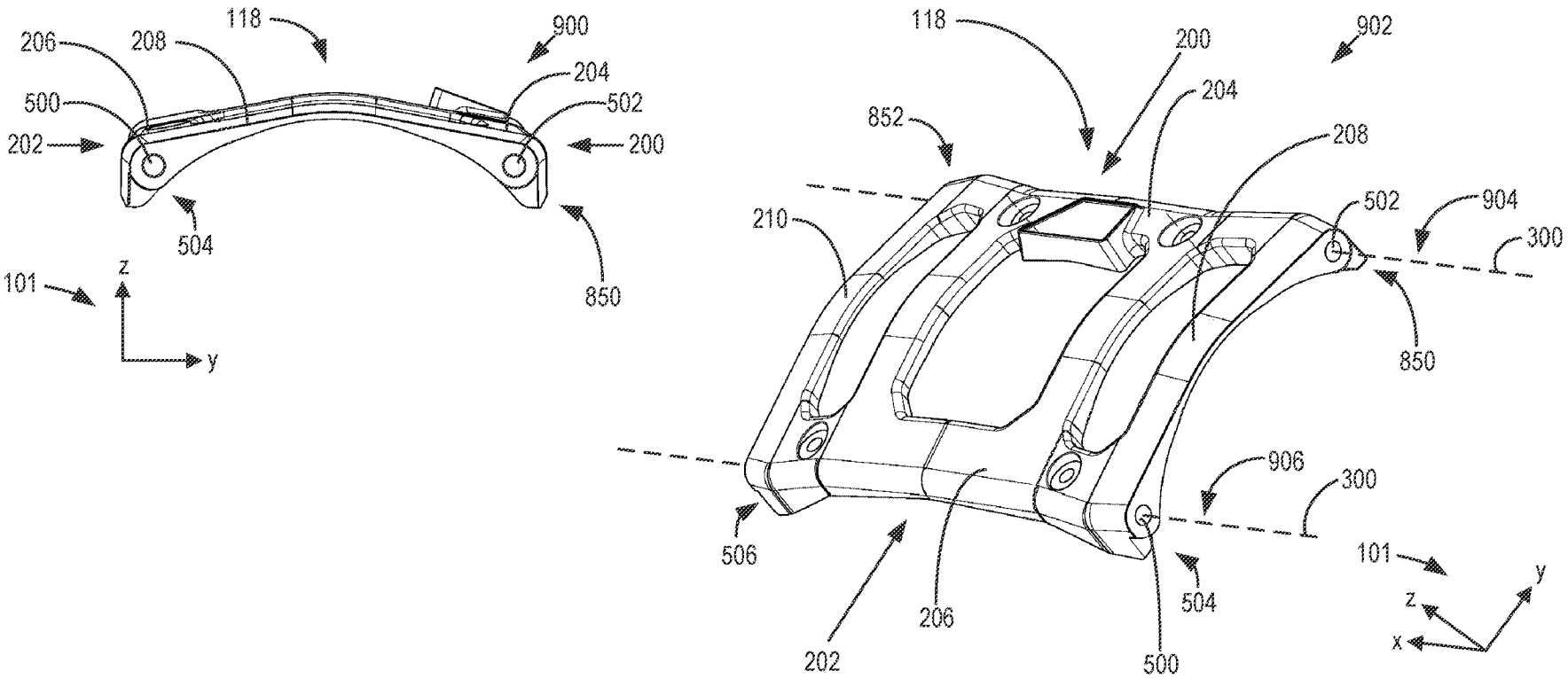
FIG. 9 shows two views of a third embodiment of a rotatable tie structure including notches formed at both a first side and a second side of the tie structure.

The following detailed description relates to systems and methods for a winch including a rotatable tie structure. A winch, such as the winch shown by FIG. 1, includes a rotatable drum drivable by a motor and coupled with a gear set. A control module is fastened to a tie structure, such as the tie structure shown by FIG. 2. The tie structure is rotatable from a fully fastened position (shown by FIG. 3) to a plurality of partially fastened positions (such as that shown by FIG. 4). In a first embodiment, notches (shown by FIGS. 5-7) positioned at a first side of the tie structure and formed by a first and second main cross rail of the tie structure increase an amount by which the tie structure may rotate. The notches may be positioned in a manner that creates a path adjacent to the first and second drum flanges. In this way, as the tie structure is rotated, the tie structure does not contact a first and second flange of the rotatable drum. In a second embodiment, the tie structure does not include notches positioned at the first side and instead includes notches positioned at a second side of the tie structure (as shown by FIG. 8), with the second side opposite to the first side. In this way, the tie structure may be rotated in a direction opposite to the rotation direction shown by the first embodiment. In a third embodiment, the tie structure includes notches positioned at both of the first side and the second side (as shown by FIG. 9). In this configuration, the tie structure may rotate in either of the rotation directions described with reference to the first embodiment and the second embodiment depending on a configuration of fasteners coupling the tie structure to the winch.

A winch including a rotatable tie structure is described below with reference to FIGS. 1-9. Each of FIGS. 1-9 show the winch and/or tie structure from different views. FIGS. 1-7 show a first embodiment including a rotatable tie structure, while FIG. 8 shows a second embodiment and FIG. 9 shows a third embodiment. Reference axes 101 are included by each of FIGS. 1-9 for comparison of each view.

Figure 1:
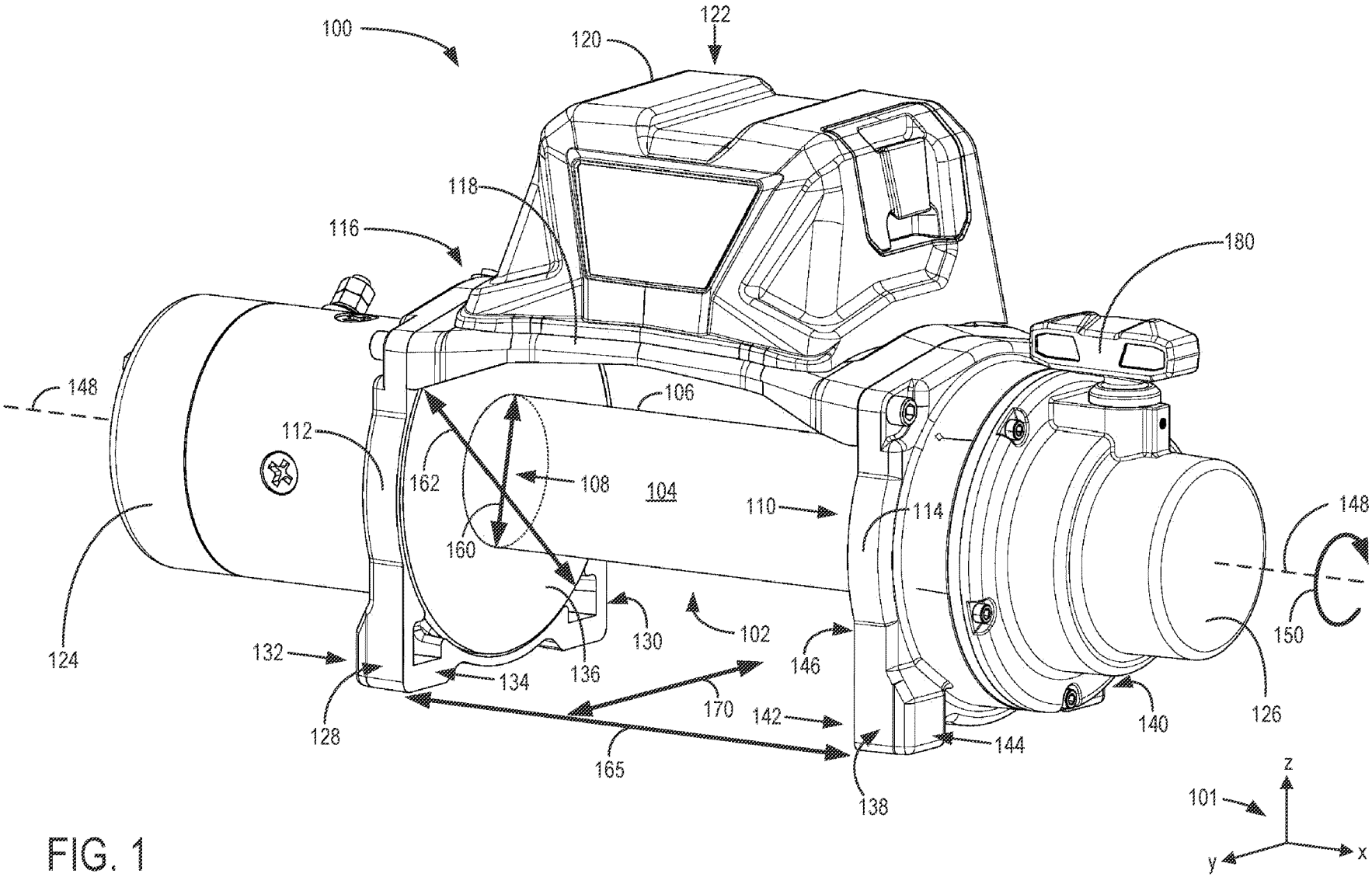
FIG. 1 shows a perspective view of a winch including a rotatable tie structure and a control unit mounted to the tie structure.

FIG. 1 shows a perspective view of a winch 100 including a rotatable tie structure 118 (which may also be referred to as a tie plate) and housing 116. Housing 116 includes a first drum support 112 and a second drum support 114. The housing 116 further includes a motor housing 124 directly coupled to the first drum support 112 and a gear housing 126 directly coupled to the second drum support 114. A motor is disposed within the motor housing 124 and a gear reduction unit including a plurality of gears (e.g., such as a planetary gear set) and a clutch is disposed within the gear housing 126. The tie structure 118 is positioned at a top side 122 of the winch 100 and is shown coupled with a control unit 120. In one example, control unit 120 may include an electronic controller (such as a microcontroller) and may control a speed of the motor within the motor housing 124 and/or a gear selection of a gear set (e.g., gear reduction unit) positioned within the gear housing 126. The motor and gear set are each coupled to a drum 102 of the winch 100 in order to rotate the drum 102 around central axis 148. The drum 102 is coupled to the motor through the gear reduction unit which is coupled to the motor through an interior of a cylindrical portion 104 of the drum 102. The control unit 120 may also control a position of the clutch disposed within the gear housing 126. The clutch may engage and disengage the gear reduction unit (e.g., transmission of the winch) with a drum 102 of the winch 100, thereby allowing the drum 102 to be driven by the motor or freespool (e.g., freely rotate without input from the motor and gear reduction unit). The clutch may be manually actuated via a clutch lever 180 positioned on a top side of an outside of the gear housing 126.

In one example operation of the winch 100, the motor may drive the drum 102 to rotate around the central axis 148 in a first direction 150 or a second direction opposite to the first direction. For example, the motor may be driven in the first direction 150 in order to rotate the drum 102 around the central axis 148, and the motor may be driven in the second direction opposite to the first direction in order to rotate the drum 102 around the central axis in the second direction. In this example, a selected gear of the gear set may adjust a rotational speed of the drum relative to a rotational speed of the motor. In one example, a rope (e.g., cable), such as the rope 290 shown by FIG. 2, may be wound around an outer surface 106 of the drum 102 in order to perform pulling operations via the winch 100.

The drum 102 includes a first flange 136 positioned at a first end 108 of the cylindrical portion 104 of the drum 102 and a second flange 146 positioned at a second end 110 of the cylindrical portion 104 of the drum 102. The first flange 136 and second flange 146 each are cylindrical in shape and have a diameter 162 that is greater than a diameter 160 of the cylindrical portion 104 of the drum 102 (e.g., the portion extending between the first flange 136 and second flange 146). The first flange 136 is supported by first drum support 112 while the second flange 146 is supported by second drum support 114. The first flange 136 and second flange 146 are coupled with their respective supports (e.g., first drum support 112 and second drum support 114, respectively) such that each flange is rotatable within the corresponding drum support when the motor is actuated to drive the drum 102 (or when the drum is in a freespool mode). In other words, as the motor within motor housing 124 is energized (e.g., via operator interaction with the control unit 120), the motor may drive the drum 102 to rotate around the central axis 148. As the drum 102 is driven, the first flange 136 rotates within the first drum support 112 and the second flange 146 rotates within the second drum support 114.

The first drum support 112 includes a first end 128, a second end 130, an inner surface 134, and an outer surface 132. The first end 128 of the first drum support 112 is positioned opposite to the second end 130 of the first drum support 112 in a direction perpendicular with the central axis 148. In other words, the first end 128 of the first drum support 112 is positioned away from the central axis 148 in a first direction, and the second end 130 of the first drum support 112 is positioned away from the central axis 148 in a second direction, with the second direction being opposite to the first direction. The first flange 136 is coupled within the first drum support 112 at the inner surface 134, and the motor housing 124 is directly coupled to the outer surface 132 of the first drum support 112. In this way, an inner end of the motor housing 124 is capped by the first drum support 112, at the outer surface 132 and thus the motor is contained within an interior space formed by walls of the motor housing 124 and the first drum support 112.

Similarly, the second drum support 114 includes a first end 138, a second end 140, an inner surface 142, and an outer surface 144. The first end 138 of the second drum support 114 is positioned opposite to the second end 140 of the second drum support 114 in a direction perpendicular with the central axis 148. In other words, the first end 138 of the second drum support 114 is positioned away from the central axis 148 in a first direction, and the second end 140 of the second drum support 114 is positioned away from the central axis 148 in a second direction, with the second direction being opposite to the first direction. The second flange 146 is coupled within the second drum support 114, at the inner surface 142 and the gear housing 126 is directly coupled to the outer surface 144 of the second drum support 114. In this way, an inner end of the gear housing 126 is capped by the second drum support 114, at the outer surface 144 and thus the gear reduction unit is contained within an interior space formed by walls of the gear housing 126 and the second drum support 114.

As an example, distance 170 indicates a length between the first end 128 and second end 130 of the first drum support 112, with the distance 170 being in a direction perpendicular to the central axis 148. Similarly, distance 170 also indicates a length between the first end 138 and second end 140 of the second drum support 114. In other words, the first end 128 is positioned away from the second end 130 of the first drum support 112 by a same distance that the first end 138 is positioned away from the second end 140 of the second drum support 114.

The first drum support 112 and second drum support 114 are positioned opposite relative to each other along the central axis 148. For example, inner surface 134 of first drum support 112 is positioned a distance 165 from inner surface 142 of second drum support 114, with the distance 165 being in a direction parallel with the central axis 148. The outer surface 132 of the first drum support 112 is positioned away from the inner surface 134 of the first drum support 112, away from the inner surface 142 of the second drum support 114, and toward the motor housing 124 along the central axis 148. The outer surface 144 of the second drum support is positioned away from the inner surface 142 of the second drum support, away from the inner surface 134 of the first drum support, and toward the gear housing 126 along the central axis 148. First drum support 112 and second drum support 114 are coupled together in part by tie structure 118, described in further detail below with reference to FIG. 2. The tie structure 118 may be the only component of the winch 100 that is coupled directly to and between each of the first drum support 112 and the second drum support 114 above the drum 102.

Figure 2:
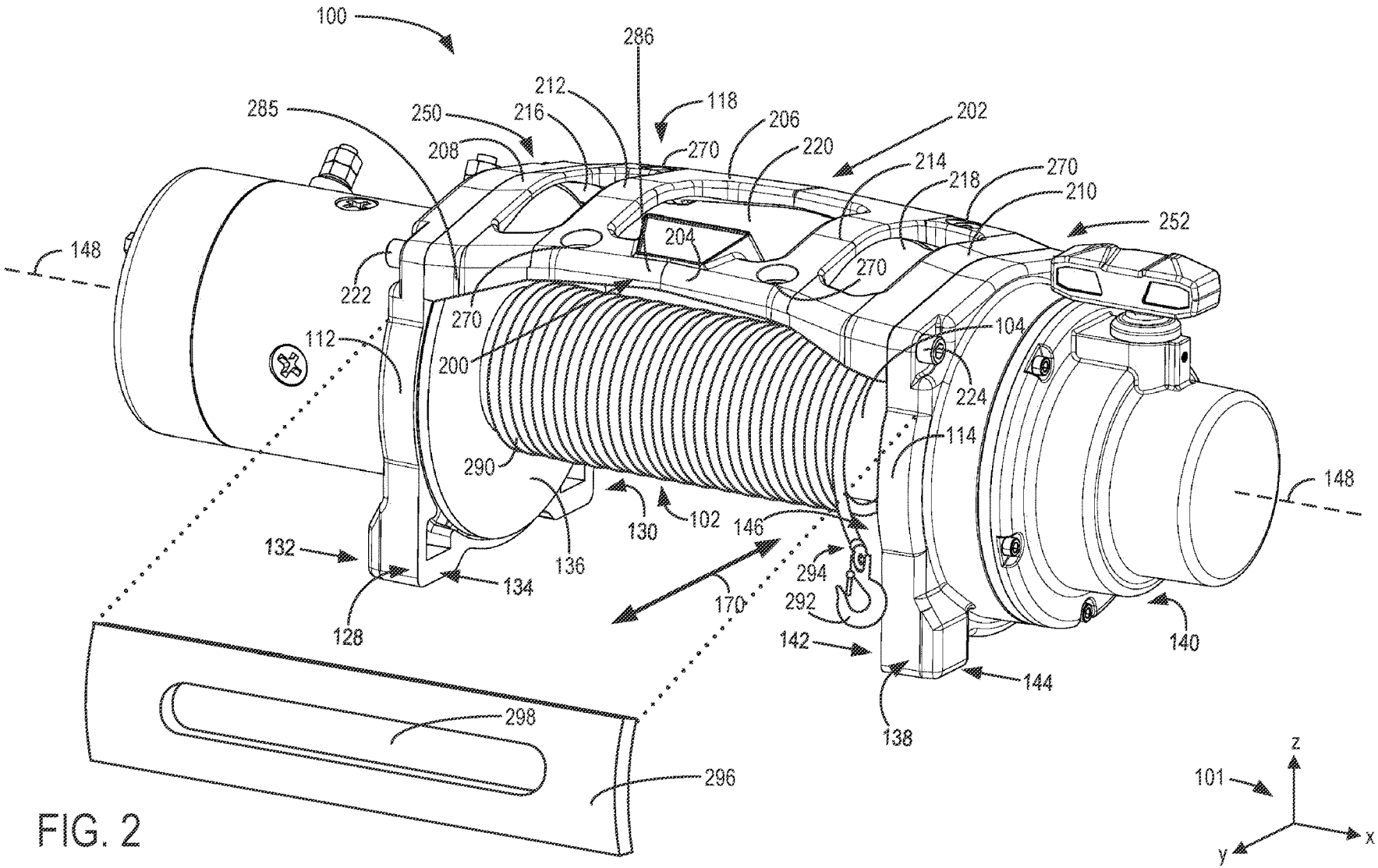
FIG. 2 shows a perspective view of the winch with the control unit removed from the tie structure.

FIG. 2 shows the winch 100 with the control unit 120 (shown by FIG. 1) removed from the tie structure 118. FIG. 2 additionally shows a rope 290 wound around the outer surface 106 of the cylindrical portion 104 of drum 102. The first flange 136 and second flange 146 provide surfaces separating the rope 290 from the first drum support 112 and the second drum support 114. In other words, the rope 290 is not in contact with either of the first drum support 112 or second drum support 114 and is instead wound entirely between the first flange 136 and second flange 146 such that the rope 290 does not rub against the surfaces of the first drum support 112 and second drum support 114 during operation of winch 100. In one example, an end 294 of the rope 290 may be coupled with a hook 292 via a knot or fastener. The hook 292 and rope 290 may be utilized by an operator of the winch 100 during pulling operations in order to apply a pulling force to an object with the winch 100. A fairlead 296 may be fastened to a front of the winch 100 (as indicated by dotted lines) and includes an aperture 298 shaped to guide the rope 290 when rope 290 is inserted through the aperture 298. In one example, the fairlead 296 may include one or more fairlead mounting apertures (not shown) positioned to fit against one or more corresponding winch apertures. Fasteners (e.g., bolts) inserted through each of the fairlead mounting apertures and winch apertures may secure the fairlead 296 to the winch 100.

The tie structure 118 includes a first side 202 and a second side 200 along a width of the winch, with the first side 202 positioned opposite to the second side 200 in a direction perpendicular to the central axis 148. The first side 202 of the tie structure 118 is positioned proximate to both of the second end 130 of the first drum support 112 and the second end 140 of the second drum support 114, while the second side 200 of the tie structure 118 is positioned proximate to both of the first end 128 of the first drum support 112 and the first end 138 of the second drum support 114. A first main cross rail 208 and a second main cross rail 210 of the tie structure 118 each extend along the width of the winch between the first side 202 and the second side 200 in a direction perpendicular with the central axis 148. The first main cross rail 208 and second main cross rail 210 may each have a length (shown by FIG. 3 and described below) in the direction perpendicular with the central axis 148 approximately the same as the distance 170 described above with reference to FIG. 1. In other words, the first side 202 of the tie structure 118 is joined with the second side 200 of the tie structure 118 via the first main cross rail 208 and the second main cross rail 210.

The first main cross rail 208 is coupled to the second main cross rail 210 by a first main side rail 206 and a second main side rail 204. The first main side rail 206 extends between the first main cross rail 208 and the second main cross rail 210 along the first side 202 of the tie structure 118 in a direction parallel with the central axis 148. The second main side rail 204 extends between the first main cross rail 208 and the second main cross rail 210 along the second side 200 of the tie structure 118 in the direction parallel with the central axis 148.

In alternate embodiments, the tie structure 118 may have more or less side and cross rails than described above. For example, in one embodiment, the tie structure 118 may be solid without any openings (e.g., without central opening 220, first secondary opening 216, and second secondary opening 218).

Figure 3:
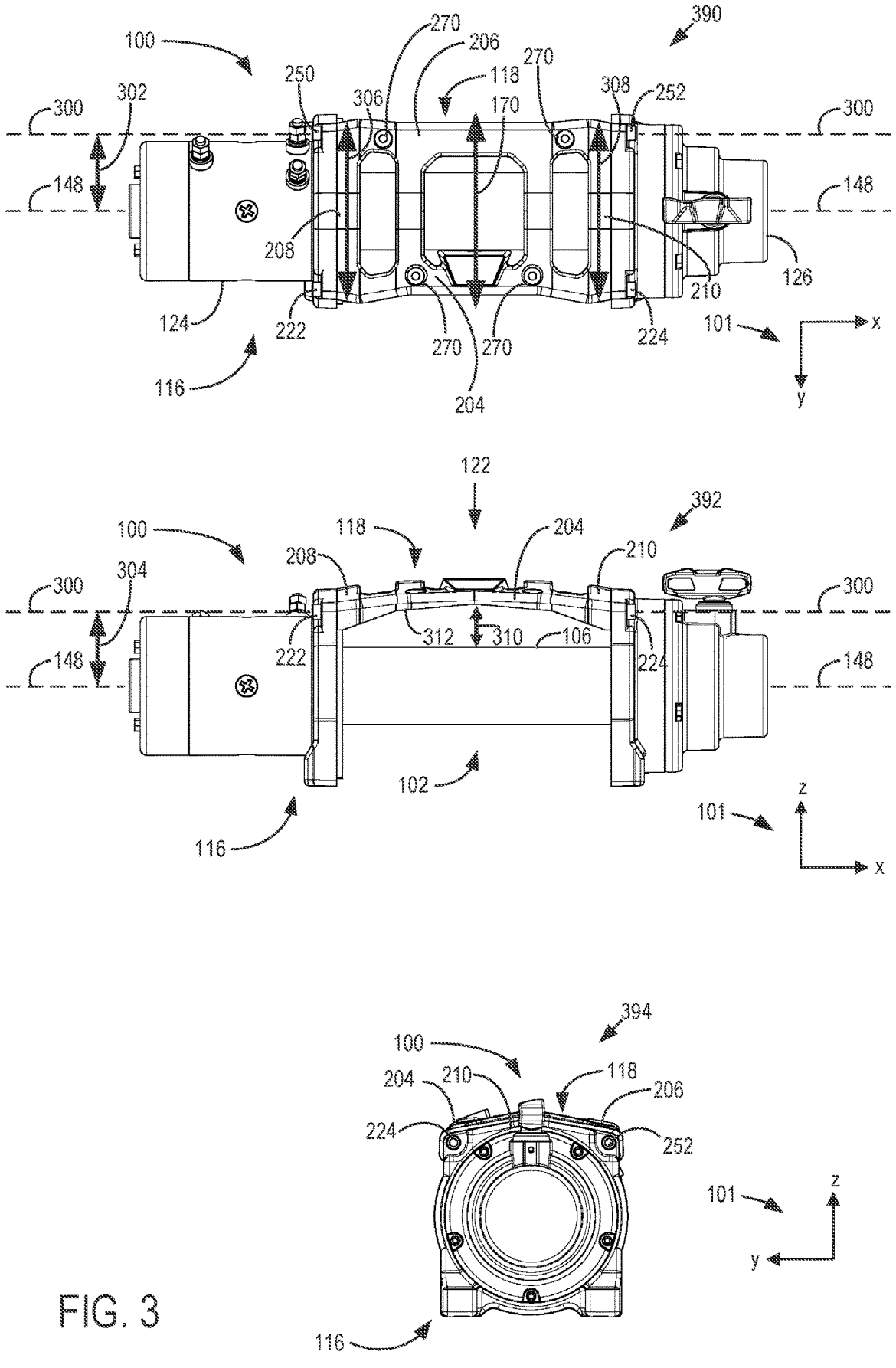
FIG. 3 shows a top view, a front view, and a side view of the winch with the control unit removed from the tie structure.

The tie structure 118 is fastened to the first drum support 112 by a first fastener 222 and a second fastener 250 (indicated by an arrow in FIG. 2 and shown explicitly by FIG. 3). Additionally, the tie structure 118 is fastened to the second drum support 114 by a third fastener 224 and a fourth fastener 252. The first fastener 222 and second fastener 250 each pass through separate apertures within the first drum support 112 and may couple to separate apertures formed by the first main cross rail 208. Similarly, the third fastener 224 and fourth fastener 252 each pass through separate apertures within the second drum support 114 and may couple to separate apertures formed by the second main cross rail 210. For example, the third fastener 224 may be inserted through an aperture (indicated by FIG. 4) formed by the second drum support 114 and may couple with an aperture (shown by FIG. 4) formed by the second main cross rail 210. In this configuration, the tie structure 118 may be bolted between the first drum support 112 and the second drum support 114, with the first main cross rail 208 and second main cross rail 210 extending in a direction perpendicular with the central axis 148, and with the first main side rail 206 and second main side rail 204 extending in a direction parallel with the central axis 148. In the example shown by FIG. 2, each of the first main side rail 206, second main side rail 204, first main cross rail 208, and second main cross rail 210 curve in a direction away from the drum 102. In other words, although the first main side rail 206 and second main side rail 204 extend in the direction parallel with the central axis 148, and although the first main cross rail 208 and second main cross rail 210 extend in the direction perpendicular with the central axis 148, the first main side rail 206, second main side rail 204, first main cross rail 208, and second main cross rail 210 may each be curved (e.g., not flat) relative to the central axis 148 such that a distance between the tie structure and the drum 102 is increased (as shown by FIG. 3 and described below). As shown in FIG. 2, the curvature of the first main side rail 206, second main side rail 204, first main cross rail 208, and second main cross rail 210 may be convex such that the curve outward and away from the drum 102 and an interior space of the winch 100. In this way, a highest portion of the tie structure 118 (e.g., positioned furthest outward from the drum 102) may be positioned in a middle portion of the tie structure 118 that is arranged along the central axis 148 and at a mid-point between the first and second main side rails. Said another way, the mid-point of each of the first main side rail 206, second main side rail 204, first main cross rail 208, and second main cross rail 210 may include the peak of the curvature of each of the rails and thus may be the highest points of the respective rails.

In one example, portions of the tie structure 118 where each main cross rail is joined with each main side rail may have an increased thickness. For example (as shown by FIG. 2), a portion 285 of the tie structure 118 where the second main side rail 204 is joined with the first main cross rail 208 has an increased thickness relative to a portion 286 of the second main side rail 204 extending between the first main cross rail 208 and second main cross rail 210. In this way, a strength of the tie structure 118 may be increased at locations where the tie structure 118 is mounted (e.g., directly coupled or fastened) to either of the first drum support 112 and second drum support 114.

As shown by FIG. 2, the tie structure 118 may also include a first additional cross rail 212 and a second additional cross rail 214 extending in a same direction as the first main cross rail 208 and second main cross rail 210. In other words, the first additional cross rail 212 and second additional cross rail 214 each extend in the direction perpendicular with the central axis 148 and couple the first main side rail 206 with the second main side rail 204. However, the first additional cross rail 212 and second additional cross rail 214 are positioned between the first main cross rail 208 and second main cross rail 210 and do not contact either of (and thus are positioned away from) the first main cross rail 208 and second main cross rail 210. A central opening 220 is positioned (e.g., formed) between the first additional cross rail 212 and second additional cross rail 214, while a first secondary opening 216 separates (and is formed between) the first additional cross rail 212 from the first main cross rail 208, and a second secondary opening 218 separates (and is formed between) the second additional cross rail 214 from the second main cross rail 210. Each of the central opening 220, first secondary opening 216, and second secondary opening 218 are formed directly above the drum 102 and a line through a center of each of the central opening 220, first secondary opening 216, and second secondary opening 218 is arranged perpendicular to the central axis 148.

A plurality of mounting apertures 270 are formed in the tie structure 118 and are each configured to receive a separate fastener when the control unit 120 (shown by FIG. 1) is coupled with the tie structure 118. In the example shown, the tie structure 118 includes two mounting apertures 270 formed at junctions of the first additional cross rail 212 and second additional cross rail 214 with the second main side rail 204 (e.g., at locations where the first additional cross rail 212 joins to the second main side rail 204 and where the second additional cross rail 214 joins to the second main side rail 204). The tie structure 118 also includes two mounting apertures 270 formed by the first main side rail 206, with one mounting aperture 270 positioned along the first main side rail 206 between the first main cross rail 208 and first additional cross rail 212, and another mounting aperture 270 positioned along the first main side rail between the second main cross rail 210 and the second additional cross rail 214. In this configuration, the control unit 120 may be fastened to the tie structure 118 by inserting fasteners through each of the mounting apertures 270 and into corresponding apertures formed by a bottom surface of the control unit 120 (not shown). In this way, the control unit 120 may be removably coupled to an outer, top surface of the tie structure 118 (e.g., the surface which faces away from the drum 102). As such, the outer, top surface of the tie structure 118 forms a mounting platform for the control unit 120 at a top side 122 of the winch 100. As shown in FIG. 2, only the first drum support 112 and second drum support 114 are directly coupled to the tie structure 118. The tie structure 118 is not coupled with any portion of the first drum support 112 or second drum support 114 below the central axis 148 and cylindrical portion 104 of drum 102. In other words, bottom portions of the first drum support 112 and second drum support 114 (e.g., portions positioned vertically below the central axis 148 as indicated by the z-axis of reference axes 101) are not coupled with the tie structure 118, and the tie structure 118 is positioned vertically above an entirety of the outer surface 106 of the cylindrical portion 104 of the drum 102. No other component of the winch (other than the control unit when mounted to the tie structure 118) is directly coupled to the tie structure 118. For example, the motor housing, gear housing, and drum are not directly coupled to the tie structure 118. In addition, the tie structure 118 is not coupled with any portion of the first flange 136 or second flange 146. No portion of the tie structure 118 is in contact with either of the first flange 136 or second flange 146 when the tie structure 118 is fastened to the winch 100 and is in a non-rotated position relative to the housing 116 of the winch 100 (as described below with reference to FIG. 3).

In the configuration described above, the tie structure 118 spans between the first drum support 112 and the second drum support 114 at a location vertically above the central axis 148 (e.g., above the central axis 148 in a direction of the z-axis indicated by reference axes 101). The tie structure 118 is coupled to the first drum support 112 by the first fastener 222 and second fastener 250 at locations vertically above an entirety of the cylindrical portion 104 of the drum 102 (and above central axis 148). Additionally, the tie structure is coupled to the second drum support 114 by the third fastener 224 and fourth fastener 252 at locations vertically above the entirety of the cylindrical portion 104 of the drum 102 (and above central axis 148). In other words, an entirety of the tie structure 118 is positioned vertically above the cylindrical portion 104 of the drum 102. No part of the tie structure 118 extends beyond the first drum support 112 in a direction of the motor housing 124, and no part of the tie structure 118 extends beyond the second drum support 114 in a direction of the gear housing 126. Said another way, the tie structure 118 spans a distance directly above the cylindrical portion 104 of the drum 102, but does not span a distance directly above either of the motor housing 124 or gear housing 126.

FIG. 3 shows the winch 100 with the control unit 120 removed in three separate views. A first view 390 is a top view from vertically above the winch 100 (e.g., from a position vertically above the top side 122 indicated in FIG. 1). A second view 392 is a front view of the winch 100 (e.g., a view showing the first end 128 of first drum support 112 and first end 138 of second drum support 114). A third view 394 is a side view of the winch 100 (e.g., a view along the central axis 148 of the gear housing 126). As noted above, reference axes 101 are included in each of the views for comparison.

As shown by first view 390, the first main cross rail 208 has a first length 306 in a direction perpendicular with the central axis 148, while the second main cross rail 210 has a second length 308 in the same direction perpendicular with the central axis 148. The first length 306 and the second length 308 are approximately a same length as the distance 170 described above with reference to FIGS. 1-2.

The second view 392 shows a distance 310 between the outer surface 106 of the drum 102 and a bottom surface 312 (which may be referred to here as inner surface 312) of the tie structure 118 in a direction perpendicular with the central axis 148 and parallel with the z-axis (indicated by reference axes 101). As described above with reference to FIG. 2, the first main cross rail 208, second main cross rail 210, first main side rail 206, and second main side rail 204 may be curved away from the central axis 148 in order to increase the distance 310 between the drum 102 and the tie structure 118.

In the first view 390 and second view 393, a rotational axis 300 of the tie structure 118 is shown. The rotational axis 300 is positioned a first distance 302 from the central axis 148 in a direction parallel with the y-axis (as indicated by reference axes 101). The rotational axis 300 is also positioned a second distance 304 from the central axis 148 in a direction parallel with the z-axis (as indicated by reference axes 101). The rotational axis 300 is positioned such that the rotational axis 300 intersects both of the second fastener 250 and the fourth fastener 252 when the second fastener 250 and fourth fastener 252 are coupled with the associated apertures of the tie structure and drum supports (as described above with reference to FIG. 2). In FIG. 3, the tie structure 118 is shown in a non-rotated position relative to the housing 116 of the winch 100 (e.g., relative to the motor housing 124, gear housing 126, first drum support 112, and second drum support 114). As described below with reference to FIG. 4, the tie structure 118 may be moved from the non-rotated position to a plurality of positions in which the tie structure 118 is rotated relative to the housing 116.

Figure 4:
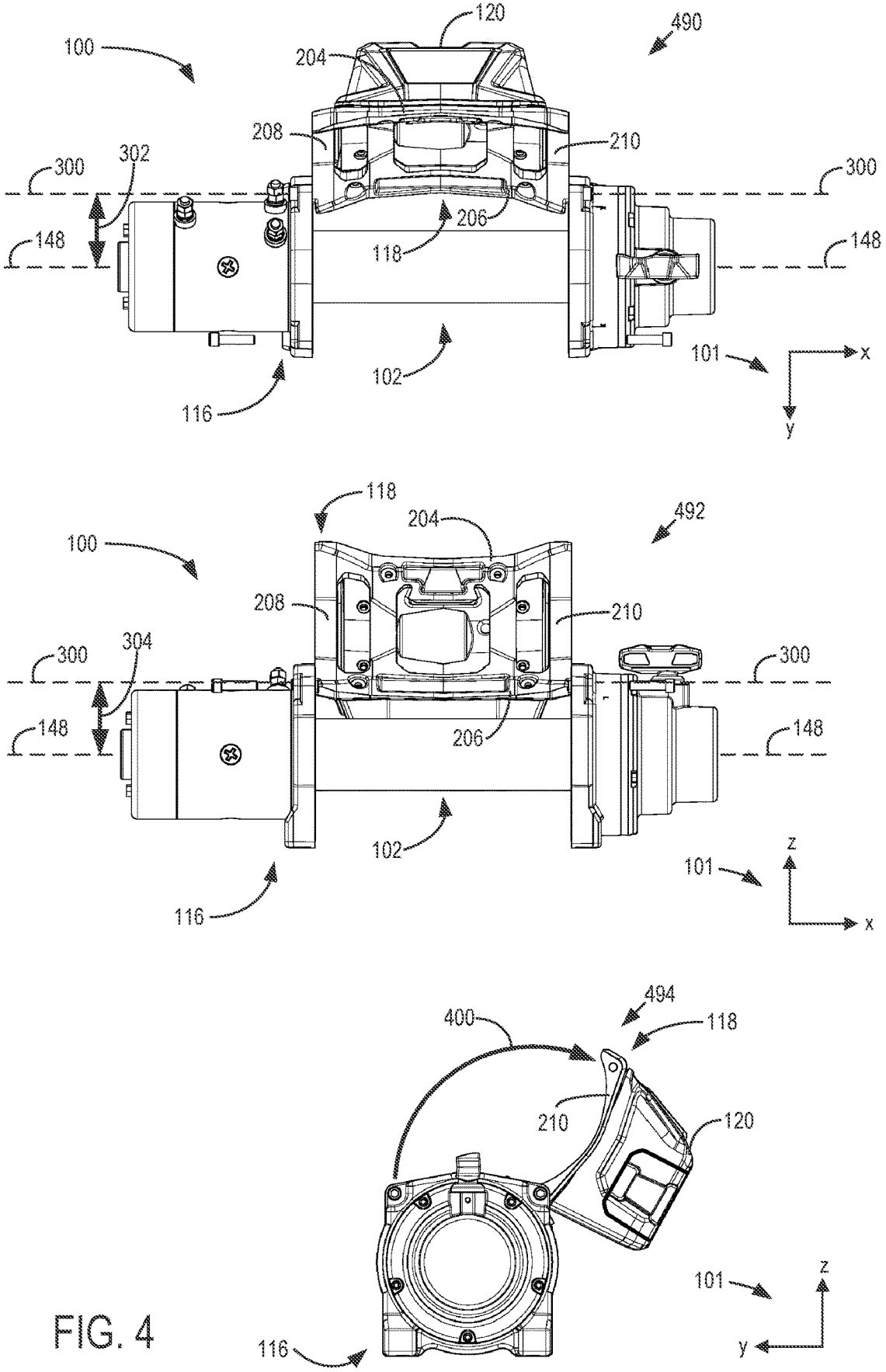
FIG. 4 shows a top view, a front view, and a side view of the winch with the control unit mounted to the tie structure, and with the tie structure rotated relative to a housing of the winch.

FIG. 4 shows a first view 490, a second view 492, and a third view 494 of the winch 100, similar to the first view 390, second view 392, and third view 394 shown by FIG. 3. In the views shown by FIG. 4, the tie structure 118 has been moved from the non-rotated position shown by FIG. 3 to a rotated position relative to the housing 116, and the control unit 120 is coupled with the tie structure 118. The rotated position shown by the views of FIG. 4 is one of a plurality of rotated positions to which the tie structure 118 may be moved. As such, in some examples the tie structure 118 may be rotated by a smaller amount than the rotational amount 400 (shown by third view 394), and in other examples, the tie structure 118 may be rotated by a greater amount than the rotational amount 400. In one example, the tie structure 118 may be rotated more than 20 degrees relative to the non-rotated position. In another example, the tie structure 118 may be rotated more than 90 degrees relative to the non-rotated position. In yet other examples, the tie structure 118 may be rotated even further relative to the non-rotated position, with no part of the tie structure 118 coming into contact with either of the first flange 136 or second flange 146, as described further below with reference to FIG. 7. In some examples, a shape of notches formed by the tie structure 118 may determine an amount that the tie structure 118 may rotate without coming into contact with the first flange 136 or second flange 146.

As shown by the first view 490 and second view 492, the tie structure 118 is rotated around the rotational axis 300. In order to rotate the tie structure 118 around rotational axis 300, the first fastener 222 and third fastener 224 are removed from the tie structure 118, while the second fastener 250 and fourth fastener 252 remain fastened to (e.g., coupled with) the tie structure 118. In one example, the second fastener 250 and fourth fastener 252 may be loosened relative to a fully tightened position of each fastener, but may not be fully removed from the winch 100. In another example, the second fastener 250 and fourth fastener 252 may be fasteners configured to rotate freely when coupled with the tie structure 118, and may also be configured in some examples to resist removal from the tie structure 118 unless a particular tool and/or removal method is utilized. With the second fastener 250 and the fourth fastener 252 coupled with the tie structure 118, and with the first fastener 222 and third fastener 224 removed from the tie structure 118, the tie structure 118 (and therefore, the control unit 120 coupled to the tie structure 118) is able to rotate around the rotational axis 300. By configuring the winch 100 and tie structure 118 in this way, the tie structure 118 and control unit 120 may be rotated away from the drum 102 so that the drum 102 may be accessed by an operator of the winch without fully removing the tie structure 118 and/or the control unit 120 from the winch 100. In order to reduce a likelihood of the tie structure 118 from rotating into contact with the first flange 136 and/or second flange 146 (shown by FIG. 1), the tie structure 118 includes a plurality of notches as shown by FIG. 5 and described below.

FIG. 5 shows a first view 590 and a second view 592 of the tie structure 118 removed from the winch 100 (shown by FIGS. 1-4 and described above). The first view 590 shows the tie structure 118 from the first side 202 (as shown by FIG. 2), while the second view 592 shows the tie structure 118 from a side of the first main cross rail 208. A notch 504 of the tie structure 118 is shown in a first enlarged view 582 corresponding to a first portion 580 of the first view 590. The notch 504 is additionally shown in a second enlarged view 586 corresponding to a second portion 584 of the second view 592. The notch 504 is formed in the first main cross rail 208, at an end of the first main cross rail 208 that couples to the first main side rail 206. A second notch 506 is shown positioned away from the notch 504 in the first view 590 and is formed in the second main cross rail 210, at an end of the second main cross rail 210 that couples to the first main side rail 206. The second notch 506 includes similar surfaces relative to the notch 504. As such, the notch 504 is described herein as a representative notch of the first main cross rail 208, with the second notch 506 of the second main cross rail 208 formed by a similar arrangement of surfaces of the second main cross rail 208.

The first main cross rail 208 includes a first surface 508 configured to be in face-sharing contact with the inner surface 134 of the first drum support 112 when the tie structure 118 is coupled to the winch 100 in the non-rotated position (as shown by FIG. 1). The first surface 508 forms an aperture 500 configured to receive the second fastener 250 as described above with reference to FIG. 2. The first surface 508 is joined with a second surface 516. The second surface 516 is arranged perpendicular with the first surface 508 and extends toward the first secondary opening 216. The second surface 516 includes a curved portion 518 joined with a notched portion 520. The curved portion 518 curves in a direction around the aperture 500, with the notched portion 520 arranged approximately perpendicular with the central axis 148 (shown by FIG. 1) and parallel with a vertical axis indicated by the z-axis of references axes 101 when the tie structure 118 is coupled to the winch 100 in the non-rotated position.

As shown by first distance 550 and second distance 552 from midpoint 560 of aperture 500, an edge of the first surface 508 may have a relatively same radius of curvature around the aperture 500. As the first surface 508 extends away from the aperture 500, the first surface 508 may taper relative to the portion surrounding aperture 500.

The notch 504 is formed by a third surface 510 arranged approximately parallel with the first surface 508 and a fourth surface 514 arranged perpendicular to the first surface 508, with the fourth surface 514 curving around the aperture 500. The third surface 510 is offset relative to the first surface 508 by a length 512 shown as a distance between a first axis 522 aligned with the third surface 510 and a second axis 524 aligned with the first surface 508. Each of the first axis 522 and second axis 524 are positioned parallel with the notched portion 520. In this way, third surface 510 is depressed into a portion of the first main cross rail 208 from the first surface 508, thereby forming the notch 504.

Figure 6:
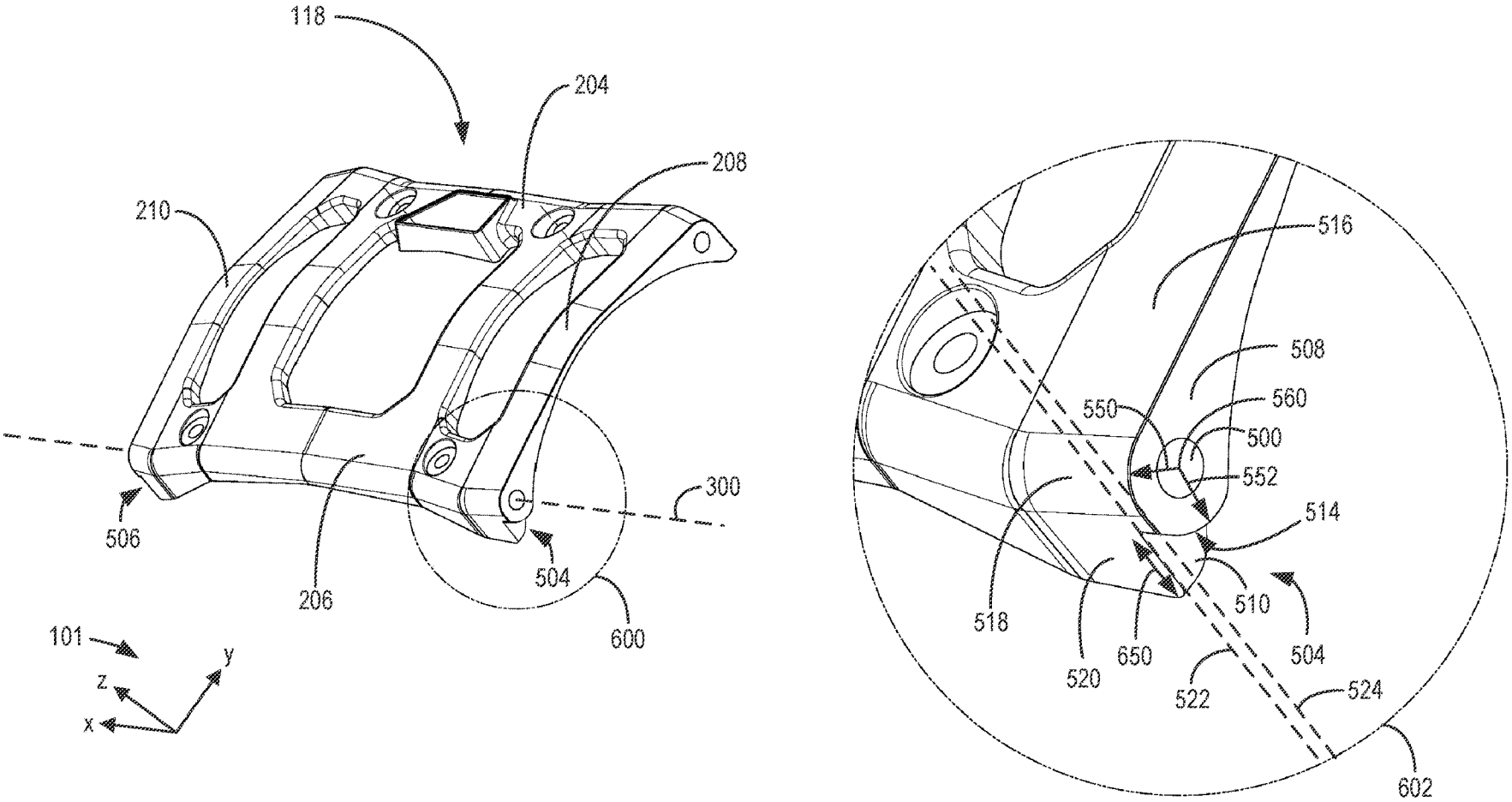
FIG. 6 shows a perspective view of the tie structure and additionally includes an enlarged view of the notch of the tie structure.

FIG. 6 shows a perspective view of the tie structure 118 separated from the winch 100, and includes an enlarged view 602 of the portion 600. Similar to the views shown by FIG. 5, the notch 504 is shown positioned along the first main cross rail 208. In one example, a length 650 of the third surface 510 may be approximately a same amount of length as the distance 552 described above with reference to FIG. 5. In other words, the length 650 may be a result of an increased thickness of the tie structure 118 where the first main cross rail 208 joins with the first main side rail 206 and may increase a strength of the tie structure 118, as described in another example above with reference to FIG. 2. Second notch 506 is shown positioned along the second main cross rail 210. Together, the notch 504 and second notch 506 increase a rotational range of the tie structure 118 relative to the housing 116 of the winch 100, as shown by FIG. 7 and described below.

Figure 7:
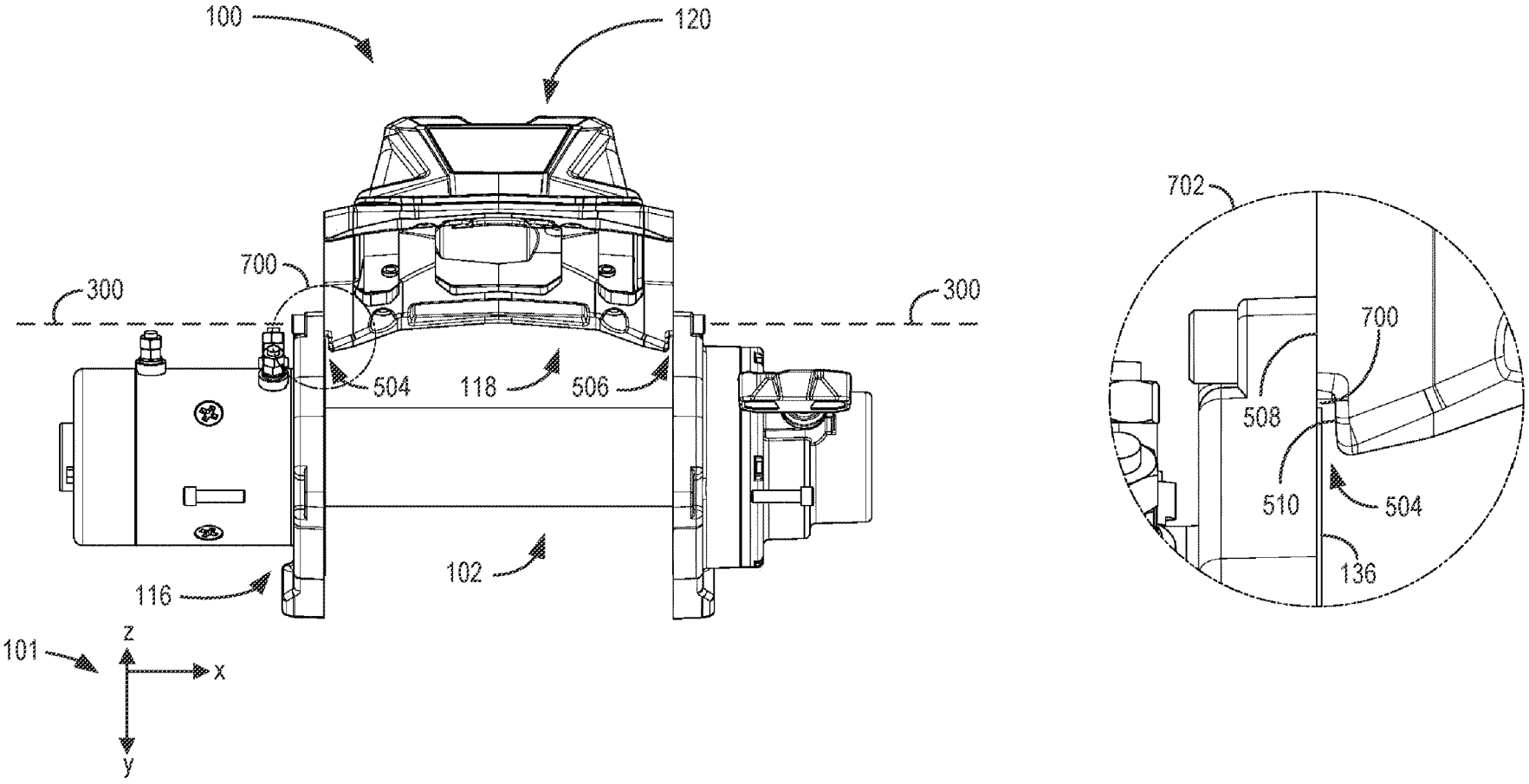
FIG. 7 shows a back view of the winch with the control unit mounted to the tie structure and the tie structure in a rotated position, and additionally includes an enlarged view of the notch of the tie structure.

FIG. 7 shows a view of the tie structure 118 coupled to the winch 100, with the control unit 120 coupled to the tie structure 118 and the tie structure 118 in a rotated position relative to the housing 116 of the winch 100.

As described above with reference to FIG. 5, the third surface 510 of the first main cross rail 208 is offset from the first surface 508 by a length 512. In this configuration, as the tie structure 118 is moved from a non-rotated position (such as the position shown by FIG. 1) to a rotated position (such as the position shown by FIG. 7), the notch 504 formed from the third surface 510 being offset from the first surface 508 decreases a likelihood of the first main cross rail 208 from coming into contact with the first flange 136 (also shown by FIG. 1) of drum 102. In other words, when the tie structure 118 is rotated, the third surface 510 swings past the first flange 136 and does not touch the first flange 136. Similarly, the second notch 506 decreases a likelihood of the second main cross rail 210 from coming into contact with the second flange 146 (indicated by FIG. 1). As shown in FIG. 7, in the rotated position, the surfaces of the notch 506 are positioned around a top portion of the first flange 136. In the non-rotated position, the surfaces of the notch 506 may be positioned completely above the first flange 136. In this way, the tie structure 118 may be rotated away from the drum 102 in order to increase an accessibility of the drum 102 without fully decoupling the tie structure 118 from the winch 100. In one example, the distance 550 and the distance 552 of the edge of the first surface 508 from the midpoint 560 of the aperture 500 (e.g., the radius of curvature of the edge of the first surface 508 proximate to the aperture 500) may be decreased relative to the distances shown by FIGS. 5-7 in order to provide an increased amount of distance between the first flange 136 and the fourth surface 514. In other words, gap 700 indicated in FIG. 7 may be increased in order to further reduce the likelihood of the first main cross rail 208 from coming into contact with the first flange 136.

In the first embodiment shown by FIGS. 1-7, the tie structure 118 includes the notch 504 and the second notch 506 positioned at the first side 202 of the tie structure 118 as described above, but the tie structure 118 does not include additional notches similar to notch 504 and second notch 506 positioned at the second side 200. In a second embodiment described below with reference to FIG. 8, the tie structure 118 does not include the notch 504 or second notch 506 positioned at the first side 202, but instead includes notch 850 and notch 852 (similar to notch 504 and second notch 506, respectively) positioned at the second side 200. In a third embodiment described below with reference to FIG. 9, the tie structure 118 includes the notch 504 and the second notch 506 positioned at the first side 202, as well as the notch 850 and the notch 852 positioned at the second side 200.

In the second embodiment shown by FIG. 8 (e.g., shown by first view 800 and second view 802), the rotational axis 300 may be positioned such that the rotational axis 300 intersects both of the first fastener 222 and the third fastener 224 (shown by FIG. 2) when the first fastener 222 and third fastener 224 are coupled with the associated apertures of the tie structure and drum supports. In other words, the first fastener 222 couples to the tie structure 118 at a location proximate to the notch 850, and the third fastener 224 couples to the tie structure 118 at a location proximate to the notch 852. In order to rotate the tie structure 118 around rotational axis 300 when the rotational axis 300 intersects the first fastener 222 and the third fastener 224 (e.g., when the rotational axis 300 is in the position indicated by arrow 860), the second fastener 250 and fourth fastener 252 are removed from the tie structure 118, while the first fastener 222 and third fastener 224 remain fastened to (e.g., coupled with) the tie structure 118. In one example, the first fastener 222 and third fastener 224 may be loosened relative to a fully tightened position of each fastener, but may not be fully removed from the winch 100. In another example, the first fastener 222 and third fastener 224 may be fasteners configured to rotate freely when coupled with the tie structure 118, and may also be configured in some examples to resist removal from the tie structure 118 unless a particular tool and/or removal method is utilized. In this configuration, the tie structure 118 (and control unit 120, when the control unit 120 is coupled to the tie structure 118) may be rotated away from the drum 102 in a direction opposite to the rotation shown by FIG. 4 and FIG. 7. In other words, the tie structure 118 may rotate away from the drum 102 in a direction of the first end 128 of the first drum support 112 and the first end 138 of the second drum support 114.

In this configuration, the tie structure 118 includes notch 850 (e.g., similar to notch 504) formed by the first main cross rail 208 at the second side 200 of the tie structure 118 (e.g., at a location proximate to the first end 128 of the first drum support 112). The tie structure 118 additionally includes notch 852 (e.g., similar to second notch 506) formed by the second main cross rail 210 at the second side 200 of the tie structure 118 (e.g., at a location proximate to the first end 138 of the second drum support 114). In this way, the tie structure 118 may rotate as described above without coming into contact with either of the first flange 136 or second flange 146.

In the third embodiment shown by FIG. 9 (e.g., shown by first view 900 and second view 902), the rotational axis 300 may be positioned according to a preference of the operator. In one example, the rotational axis 300 may intersect both of the second fastener 250 and the fourth fastener 252 when the second fastener 250 and fourth fastener 252 are coupled with the associated apertures of the tie structure and drum supports, and when the first fastener 222 and third fastener 224 are removed from the tie structure 118 and winch 100. In other words, the rotational axis 300 may be in the position indicated by arrow 906. In this configuration, the tie structure 118 may rotate according to the embodiment shown by FIGS. 1-7 and described above. In other words, the tie structure 118 rotates away from the drum 102 and away from the first end 128 and second end 130 of the first drum support 112 and the first end 138 and second end 140 of the second drum support 114. For example, the second fastener 250 and fourth fastener 252 may be loosened relative to a fully tightened position of each fastener, but may not be fully removed from the winch 100, while the first fastener 222 and third fastener 224 are fully removed from the winch 100. In a second example, the rotational axis 300 may intersect both of the first fastener 222 and the third fastener 224 when the first fastener 222 and third fastener 224 are coupled with the associated apertures of the tie structure and drum supports, and when the second fastener 250 and fourth fastener 252 are removed from the tie structure 118 and winch 100. In other words, the rotational axis 300 may be in the position indicated by arrow 904. In this configuration, the tie structure 118 may rotate in a direction opposite to the rotation shown by FIG. 4 and FIG. 7. In other words, the tie structure 118 rotates away from the drum 102 and in a direction of the first end 128 and second end 138 of the first drum support 112 and second drum support 114, respectively. For example, the first fastener 222 and third fastener 224 may be loosened relative to a fully tightened position of each fastener, but may not be fully removed from the winch 100, while the second fastener 250 and fourth fastener 252 are fully removed from the winch 100.

In third embodiment described above (e.g., in which the rotational axis 300 is positioned according to the preference of the operator), the tie structure 118 includes notch 504 formed by the first main cross rail 208 and positioned at the first side 202 of the tie structure 118, notch 850 formed by the first main cross rail 208 and positioned at the second side 200 of the tie structure 118, notch 506 formed by the second main cross rail 210 and positioned at the first side 202 of the tie structure 118, and notch 852 formed by the second main cross rail 210 and positioned at the second side 200 of the tie structure 118. In this way, the tie structure 118 may rotate according to either of the examples described above without coming into contact with either of the first flange 136 or second flange 146. In this way, as one example, the operator may remove the first fastener 222 and third fastener 224 in order to rotate the tie structure 118 away from the drum 102 and toward the front ends of the drum supports (e.g., in a direction of first end 128 and first end 138). In another example, the operator may instead remove the second fastener 250 and fourth fastener 252 in order to rotate the tie structure 118 away from the drum 102 and toward the back ends of the drum supports (e.g., in a direction of the second end 130 and second end 140).

By configuring the winch and tie structure as described above with reference to FIGS. 1-9, the tie structure may rotate relative to the housing of the winch without completely decoupling the tie structure from the winch. For example (as in the first embodiment described above), the fasteners coupled to the tie structure at the first end of the first drum support and the first end of the second drum support may be removed, while the fasteners coupled to the tie structure at the second end of the first drum support and the second end of the second drum support may remain fastened. The tie structure may then pivot along the rotational axis intersecting the remaining fasteners, with the notches of the tie structure providing an open space surrounding the drum flanges to increase the rotational range of the tie structure. In this way, an operator of the winch may move the tie structure (and the control unit, if coupled with the tie structure) away from the drum in order to access the drum for maintenance and/or servicing. Additionally, the control unit may be more easily removed from the tie structure and a rope may be more easily attached to the winch drum without removing the tie structure and control unit. An ease of operation of the winch is thereby increased, and an amount of time to service the winch is decreased.

FIGS. 1-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A winch, comprising:

a housing including a first drum support and a second drum support;

a drum rotatable about a central axis, a first end of the drum supported by the first drum support and a second end of the drum supported by the second drum support; and a tie structure positioned directly above and extending across the drum, between the first and second drum supports and from a first to second end of each of the first and second drum supports, where the tie structure is rotatable about a rotational axis arranged at a first side of the tie structure that extends across the drum from the first drum support to the second drum support.

2. The winch of claim 1, wherein the rotational axis is parallel to and positioned vertically above and offset from the central axis and wherein the tie structure is coupled to only the first and second drum supports and no other winch components.

3. The winch of any of claim 1, wherein the tie structure extends across the drum, from the first drum support to the second drum support, in a direction parallel to the central axis, and wherein the tie structure extends across the drum, along a length of each of the first drum support and second drum support, in a direction perpendicular to the central axis, where the width length is defined between the first side and second side of each of the first and second drum supports, and where the first and second sides are arranged opposite one another across the central axis.

4. The winch of claim 1, wherein the tie structure includes two main side rails and two main cross rails, where the two main side rails are each coupled to and between the first and second drum supports and separated from one another across a width of the winch and where the two main cross rails are each coupled to and between each of the two main side rails and extend along the width of the winch.

5. The winch of claim 4, wherein a first main cross rail of the two main cross rails is coupled directly to and extends across an inner surface of the first drum support and wherein a second main cross rail of the two main cross rails is coupled directly to and extends across an inner surf ace of the second drum support.

6. The winch of claim 4, wherein a first main side rail of the two main side rails forms the first side of the tie structure and the tie structure is rotatable about the first main side rail and wherein each of the two main cross rails, at an end of each of the two main cross rails that is coupled to the first main side rail, includes a notch.

7. The winch of claim 4, wherein a first main side rail of the two main side rails forms the first side of the tie structure, wherein a second main side rail of the two main side rails forms a second side of the tie structure, wherein the tie structure is rotatable about the first main side rail and the second main side rail, and wherein each of the two main cross rails include a notch at a first end that is coupled to the first main side rail and at a second end that is coupled to the second main side rail.

8. The winch of claim 4, wherein the tie structure further includes a first additional cross rail and a second additional cross rail separated from one another and coupled between the two main side rails, wherein the tie structure includes a central opening formed by the first and second additional cross rails and the two main side rails, and wherein the tie structure includes two secondary openings, smaller than the central opening, each of the two secondary openings formed between one of the first and second additional cross rails and one of the two main cross rails.

9. The winch of claim 4, wherein the tie structure includes a plurality of mounting apertures arranged in the two main side rails and further comprising a control unit removably coupled to a top, outer surface of the tie structure via the plurality of mounting apertures.

10. The winch of claim 6, further comprising a fairlead fastened to a front of the winch and wherein the first main side rail is positioned at the front of the winch.

11. The winch of claim 6, further comprising a fairlead fastened to a front of the winch and wherein a second main side rail of the two main side rails is positioned at the front of the winch.

12. The winch of claim 6, wherein the drum includes a cylindrical portion disposed between a first drum flange and a second drum flange, the first drum flange disposed within and supported by the first drum support and the second drum flange disposed within and supported by the second drum support and wherein each notch is positioned directly above one of the first and second drum flanges.

13. The winch of claim 12, wherein when a second main side rail of the two main side rails is rotated away from the first and second drum supports, each notch is positioned around, without contacting, one of the first and second drum flanges.

14. A winch, comprising:

a rotatable drum including a central rotational axis and supported within a housing of the winch, between a first drum support and a second drum support;

a tie structure directly coupled to and between only the first drum support and the second drum support, the tie structure positioned vertically above the rotatable drum and hinged at a first side of the tie structure that extends between the first and second drum supports and is adapted to rotate about a second rotational axis arranged in parallel with the central rotational axis, the tie structure including a notch at each end of the first side of the tie structure where the tie structure couples to the first and second drum supports.

15. The winch of claim 14, wherein the drum includes a cylindrical portion disposed between a first drum flange and a second drum flange, the first drum flange disposed within and supported by the first drum support and the second drum flange disposed within and supported by the second drum support and wherein the notch at each of the first side of the tie structure is positioned directly, vertically above one of the first drum flange and the second drum flange.

16. A winch, comprising:

a housing including a first drum support and a second drum support;

a rotatable drum including a cylindrical portion positioned between first and second drum flanges, the first drum flange supported by the first drum support and the second drum flange supported by the second drum support; and a rotatable tie structure positioned directly above and extending across the drum, between the first and second drum supports and from a first end to a second end of each of the first and second drum supports, the tie structure including notches that traverse a path adjacent to the first and second drum flanges when moving from a closed, first position to an open, second position.

17. The winch of claim 16, wherein in the open, second position, the tie structure rotates about a first side of the tie structure that extends between the first end of the first drum support and the first end of the second drum support and a second side of the tie structure that extends between the second end of the first drum support and the second end of the second drum support, when the tie structure is in the closed, first position, is rotated upward and away from the rotatable drum.

18. The winch of claim 16, wherein the tie structure includes two main side rails and two main cross rails, where the two main side rails are each coupled to and between the first and second drum supports and separated from one another across a width of the winch and wherein the two main cross rails are each coupled to and between each of the two main side rails and extend along the width of the winch.

19. The winch of claim 18, wherein the tie structure is rotatable about a first main side rail of the two main side rails and wherein each of the two main cross rails, at an end of each of the two main cross rails that is coupled to the first main side rail, includes one of the notches.

20. The winch of any of claim 18, wherein the tie structure is rotatable about each of a first main side rail and a second main side rail of the two main side rails and wherein each end of the two main cross rails that couples to the first main side rail and the second main side rail includes one of the notches.

* * * * *